United States Patent [19]

Hardy

[11] Patent Number: 4,580,366

[45] Date of Patent: Apr. 8, 1986

[54] SLIDING WINDOW CONSTRUCTION

[75] Inventor: Terence Hardy, Ripley, England

[73] Assignee: L. B. Plastics Limited, Derby, England

[21] Appl. No.: 672,652

[22] Filed: Nov. 19, 1984

[30] Foreign Application Priority Data

Nov. 19, 1983 [GB] United Kingdom ..... 8330937

[51] Int. Cl.[4] ..... E05D 15/16

[52] U.S. Cl. ..... 49/406; 49/458

[58] Field of Search ..... 49/458, 406, 485, 489; 52/398, 397, 824, 775, 790

[56] References Cited

U.S. PATENT DOCUMENTS 2,798,578 7/1957 Toth ..... 49/485 X 4,024,690 5/1977 Collins et al. ..... 52/397

4,040,219 8/1977 Budich ..... 52/397 X 4,110,942 9/1978 Slocomb, Jr. ..... 52/397 X

*Primary Examiner*—Philip C. Kannan

*Attorney, Agent, or Firm*—W. Thad Adams, III

[57] ABSTRACT

A sash frame for a sliding window construction comprises four frame members formed from plastics material and of identical cross-sectional profile, the frame members being fused or welded together at their corners and incorporating fixed abutments for engagement with a glazing unit, the frame also including removable glazing beads attachable to the frame members such that the glazing unit may be inserted laterally into the frame and retained in engagement with the abutments by attachment of the glazing beads to the assembled frame.

9 Claims, 10 Drawing Figures

SLIDING WINDOW CONSTRUCTION

This invention relates to sliding or sash windows which comprise an outer frame and at least two glazed inner frames at least one of which is slidable in the outer frame relative to the other inner frame or frames. The slidably movable frame or frames in such window constructions will be referred to hereinafter as sash frames.

The fixed inner frames and sash frames of such window constructions may be single or multiple glazed. At the present time double glazing is commonly employed but in some situations single glazing is preferred for cost or other reasons and in extreme conditions three or more glass panes may be employed. For purposes of simplicity the term "glazing unit" will be used herein to embrace, the single, double or multiple glazing.

Previously proposed sliding window constructions have traditionally been of wooden or aluminium construction and have incorporated sash frames formed from top, bottom and side frame members secured together by screws and finished with sealant. This construction suffers from a number of disadvantages. In particular it is difficult to secure a weather-tight seal so that problems arise through water penetration. In addition, in the event of the glazing unit being broken it is necessary to remove the sash frame, detach one frame member, replace the glazing unit and re-attach the frame member. This breaks the seals incorporated during construction and causes further water penetration problems. Moreover the glazing units are secured in the frame by traditional glazing techniques which are time consuming and make replacement of the glazing unit difficult.

It is an object of the present invention to obviate or mitigate these disadvantages.

The invention provides a sash frame for a sliding window construction, the sash frame comprising four frame members formed from plastics material and of identical cross-sectional profile, the frame members being fused or welded together at their corners and incorporating fixed abutments for engagement with a glazing unit, and removable glazing beads attachable to said frame members whereby the glazing unit may be inserted laterally into the frame and retained in engagement with said abutments by attachment of said glazing beads to the assembled frame.

Preferably a plurality of alternatively usable removable glazing beads are provided which maybe selectively attached to the frame members and are adapted to accommodate different glazing units which may be mounted in the frame.

Preferably the glazing beads are provided with retaining means adapted for engagement with complementary retaining means formed on the frame components to secure the glazing beads in position.

The glazing beads are preferably formed from plastics material and of constant cross-section throughout their length.

Advantageously the outer edges of the frame members are provided with longitudinally extending recesses to accommodate sealing members and have retaining means co-operable with complementary retaining means on cover members attachable to the outer edges of selected frame members to cover said longitudinal recesses when the latter are not required for accommodation of seals.

The cover members may incorporate sealing members engageable with complementary sealing members on an associated fixed inner frame or sash frame to form a weather seal between adjacent portions of the frames in the closed position.

The cover members and the sealing members, if provided, are preferably formed from plastics material and of constant cross-section throughout their lengths.

The invention also provides a sliding window construction comprising an outer frame and at least one sash frame constructed in accordance with the preceding paragraphs slidably mounted in the outer frame.

An embodiment of the invention will now be described, by way of example only with reference to the accompanying drawings, in which.

Figure 1:
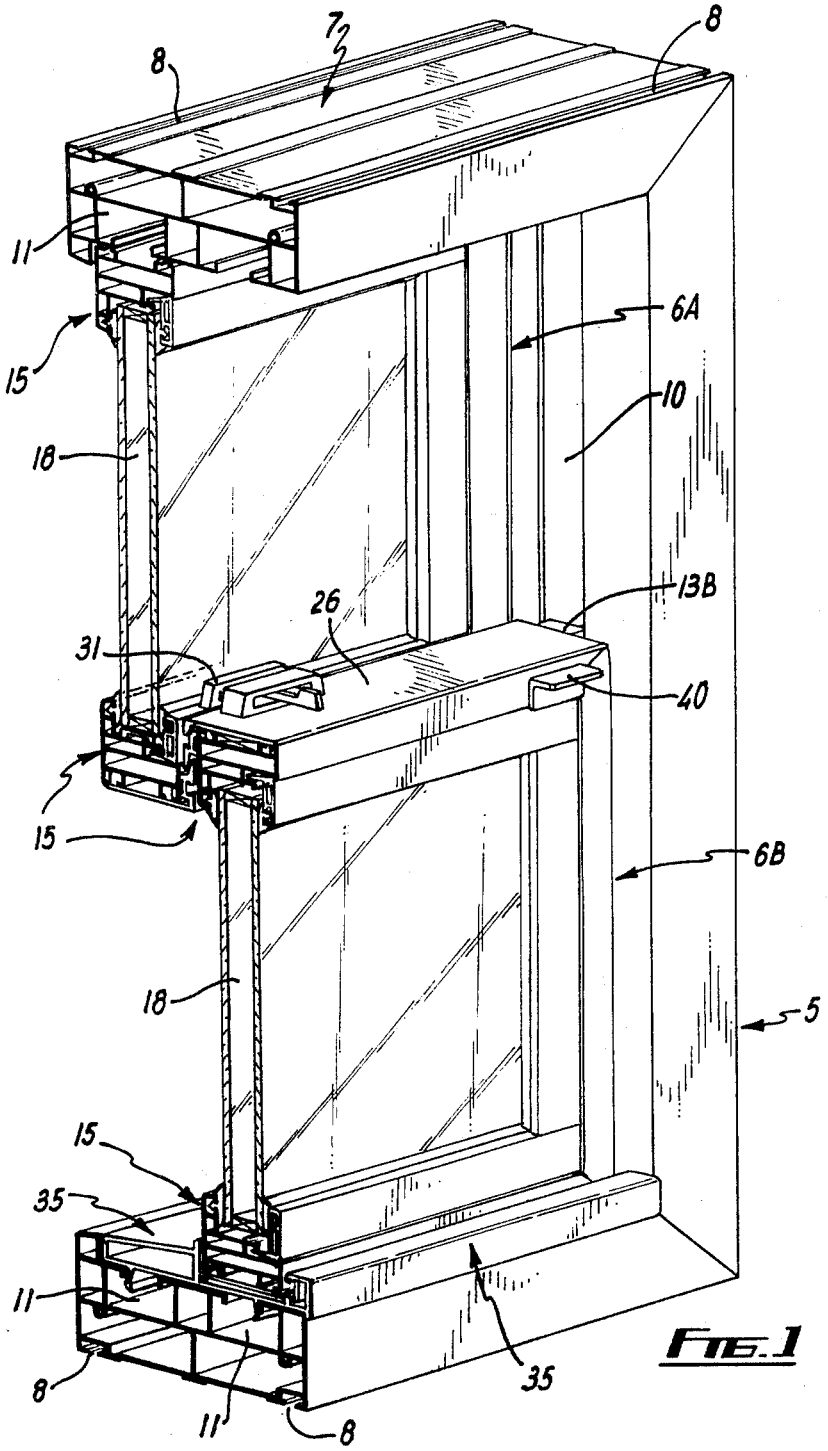
FIG. 1 is a fragmentary perspective view of a vertically opening sliding sash window constructed in accordance with the invention.

Referring to the drawings, the window comprises an outer frame 5 in which upper and lower inner sash frames 6A and 6B are slidably mounted. The outer frame 5 is constructed from top, bottom and side frame members 7 formed by extrusion from plastics material and of identical cross-section. The frame members are mitred at their corners and welded together so that all four sides of the frame are constructed from sections of the same extrusion. Longitudinally extending tracks 8 are formed in the outer edges of the frame members 7 and are adapted to receive fixing brackets (not shown) by means of which the frame may be secured in an opening in a wall or the like and, if required, drip deflectors, one of which is shown at 9 in FIG. 2. A similar drip deflector may be fitted at the upper edge of the upper frame member 7. The tracks 8 may also be used to locate jointing pieces enabling two or more frames to be connected together side-by-side.

The frame members 7 are of hollow construction and are provided with a pair of parallel longitudinal slots 10 in their inner edges leading to longitudinally extending compartments or recesses 11. When the frame members are used as side frame members, balance gear indicated at 12 is housed in the recesses 11 and connected to the sash frames 6A and 6B by connecting members 13 extending through the slots 10. The balance gear incorporates springs serving to balance the weight of the sash frames as they are moved relative to the main frame between open and closed positions. The frame members 7 also incorporated longitudinally extending tubular portions 14 which may be used as anchorage points for screws inserted through the ends of adjacent frame members in the event it is desired to interconnect the members at the corners of the frame by overlap or butjointing instead of mitring and welding.

Each of the sash frames 6A and 6B is formed from top, bottom and side frame members 15, all of the same cross-section and formed from plastics material by extrusion. The frame members are mitred at their corners and secured together by welding. Because of the construction of the sash frames this can be effected prior to glazing of the frames. Each of the frame members 15 comprises a base portion 16 and an upstanding abutment portion 17 against which an edge of a glazing unit 18 abuts. Pre-formed resilient sealing members 19 are engaged in retaining formations in the abutment portion 17 and press against the surface of the glazing unit to form a weather-tight seal. The glazing unit is retained in position by removable glazing beads 20 formed by extrusion from plastics material and having barbed locking projections 21 which engage with complementary projections 22 on the frame members. Pre-formed sealing strips 23 are engaged with retaining formations on the beads 20 and press against the adjacent surface of the glazing unit 18 when the glazing beads are engaged with the frame. Thus after assembly of the frame and welding together of the corners in a water-tight manner, the sealing strips 19 are engaged with the abutment portion 17 of the frame, the blazing unit 18 is placed in position and the glazing beads 20 fitted with the sealing strips 23 are engaged with the projections 22 on the frame thus completing glazing of the frame.

The lower end of each sash frame is pivotally connected to the associated balance gear 12 by the connecting members 13 which are pivotally located in guide blocks 13A slidably mounted in the channels 11 and forming part of the balance gear. At its upper end each corner of the sash frame is provided with a laterally extending guide member 13B (FIG. 1) which engages in the associated slot 10 to guide and stabilize the frame during opening and closing movement. The guide member 13B may be fixedly mounted in the recess 25 after location of the sash frame in the outer frame or may be slidably mounted for lateral movement between an extended position in which it engages in the slot 10 and a retracted position in which it is withdrawn clear of the slot 10 and release the upper end of sash frame enabling it to be pivotted about the connecting members 13. The guide blocks 13A are arranged to expand and lock themselves within the recesses 11 when the sash frame is tilted out of its vertical position. The upper sash frame 6A is similarly mounted for both sliding and tilting movement relative to the main frame 5.

Figure 2:
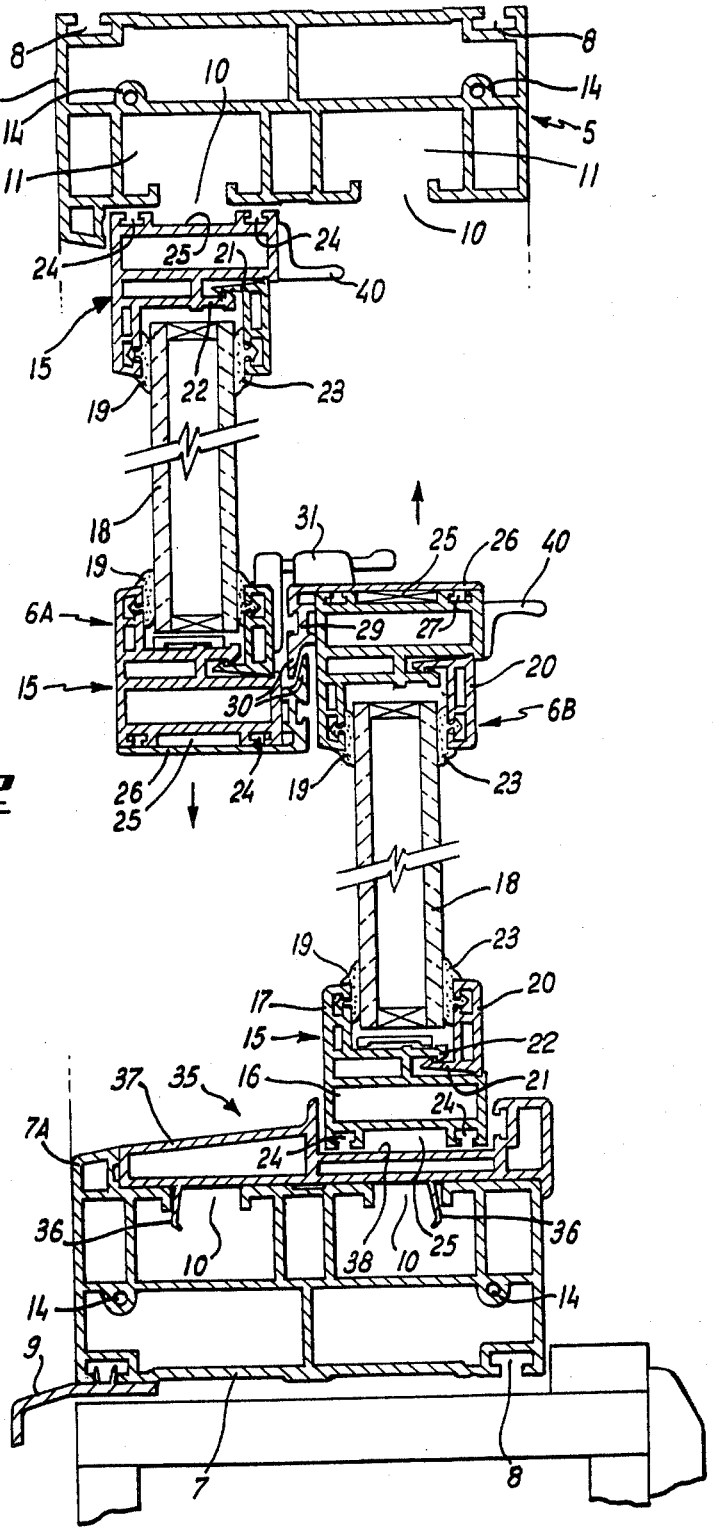
FIG. 2 is a vertical cross-section through the window construction shown in FIG. 1.

The outer edges of the frame members 15 are provided with longitudinally extending channels 24 which may accommodate brush seals (not shown) and between which is a central channel 25. Because the same frame members are used to form all four sides of the frame, these channels would be visible at the top of the lower sash frame and the underside of the upper sash frame unless suitably cloaked. For this purpose a detachable cover member 26 is provided having resilient projections 27 engageable in the associated channels 24 in order to cover the exposed edges of the frame members and provide a neat appearance. The cover member 26 is provided with a vertically directed extension 29 which extends over the edge of the associated frame member 15 and terminates in a tapering sealing portion 30. At the upper end of the lower and inner sash frame 6B the cover member 26 is fitted so that the extension 29 extends over the outer surface of the frame. On the upper and outer sash frame 6A the cover member is fitted so that the extension 29 extends over the inner face. The extensions 29 are so arranged that when the sash frames are both in their closed positions the tapering seal portions 30 overlap and abut one another thus providing a weather seal between the two frames. A locking member 31 is fitted to secure the frames together in their closed positions as shown in FIGS. 1 and 2.

As the same frame member 7 is used to construct all four sides of the outer frame 5, the slots 10 would appear as horizontal openings in the bottom frame member unless suitably cloaked. For this purpose a detachable cover piece 35 is provided for fitting to the upper surface of the lower frame member 7. Downwardly directed resilient projections 36 are provided on the cover piece 35 and engage with opposite edges of the respective slots 10 to retain the cover piece in position on the lower frame member. The cover piece comprises an outer cover portion 37 forming a sill having a sloping upper surface which mates with an abutment portion 7A on the frame member 7. The cover piece 35 also incorporates a recessed channel or track 38 extending parallel to the cover portion 37. The channel 38 is dimensioned to accommodate the lower edge of the bottom sash frame 6B and due to the recessing of the channel a weather-proof seal and a pleasing appearance are provided when the lower sash frame 6B is in its closed position. Thus the lower frame member 7 may be simply and quickly modified to provide the sill 37 and channel 38 by simply clipping the cover piece 35 into engagement with slots 10.

In order to facilitate sliding movement of the sash frames 6A and 6B, handles 40 are provided at the upper corners of each of the sash frames. The handles 40 also serve to actuate a tilt release mechanism shown in FIGS. 4 to 9 which enables the guide members 13B to be withdrawn from the slots 10 in the outer frame 5, thereby enabling the sash frames to be pivoted about the connecting members 13 at their lower ends to tilt the frames out of the plane of the main frame 5 and enable access to be gained to the outer surfaces of the glazing units for cleaning purposes.

Figure 4:
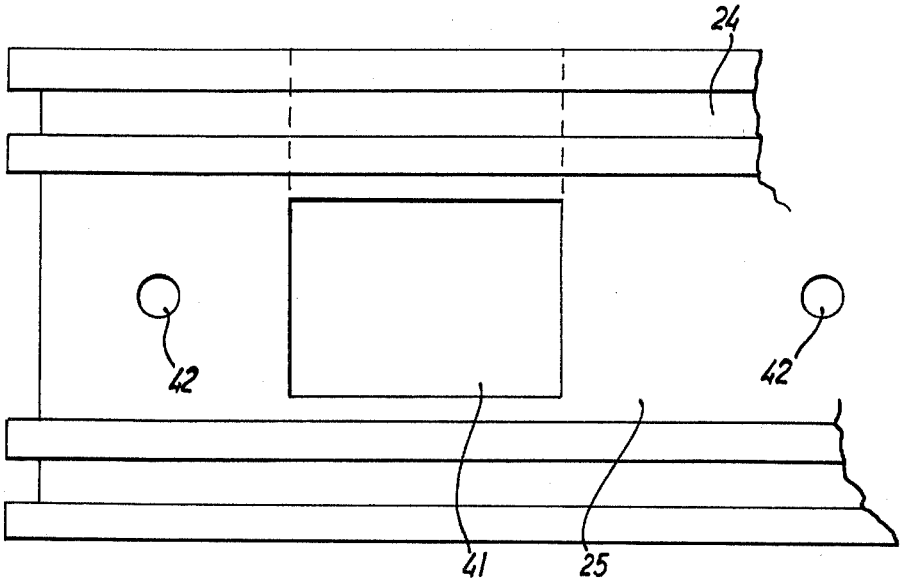
FIG. 4 is an enlarged fragmentary plan view showing an upper corner of a sliding sash frame with components of the tilt release mechanism omitted to show the openings formed in the frame.
Figure 5:
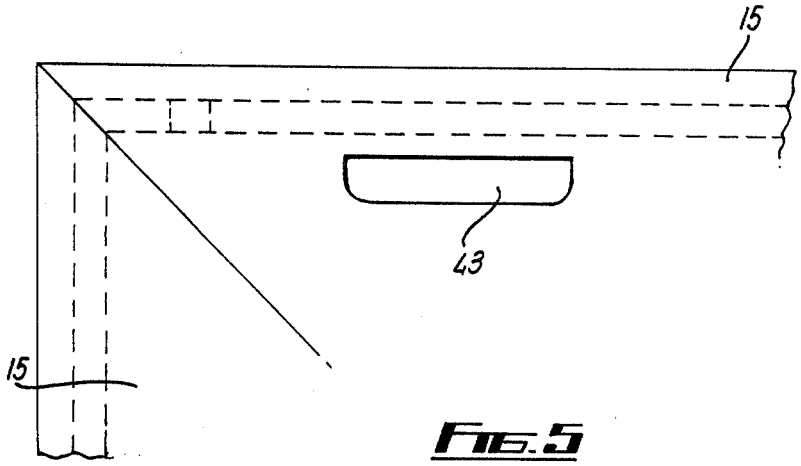
FIG. 5 is a front elevation of the corner shown in FIG. 4.
Figure 6:
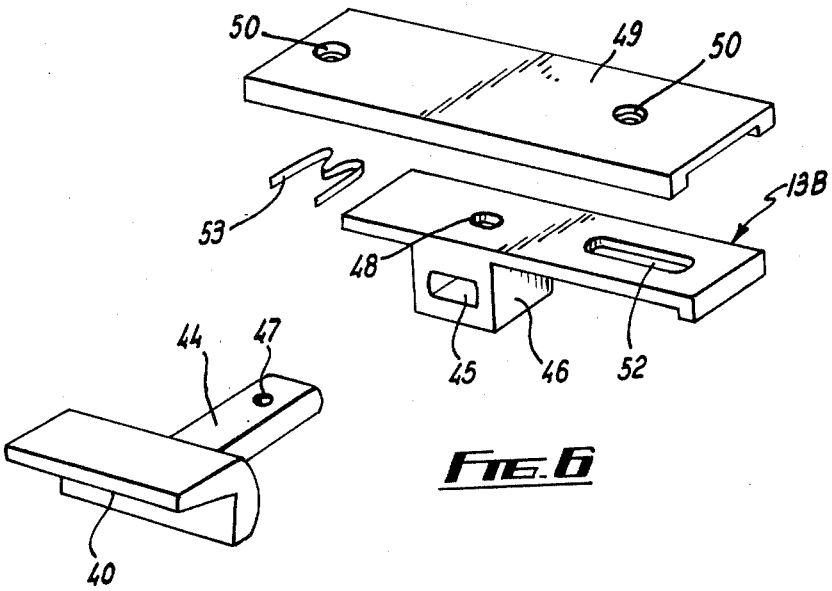
FIG. 6 is an exploded perspective view of the components of the tilt release mechanism incorporated in the frame shown in FIGS. 4 and 5.
Figure 7:
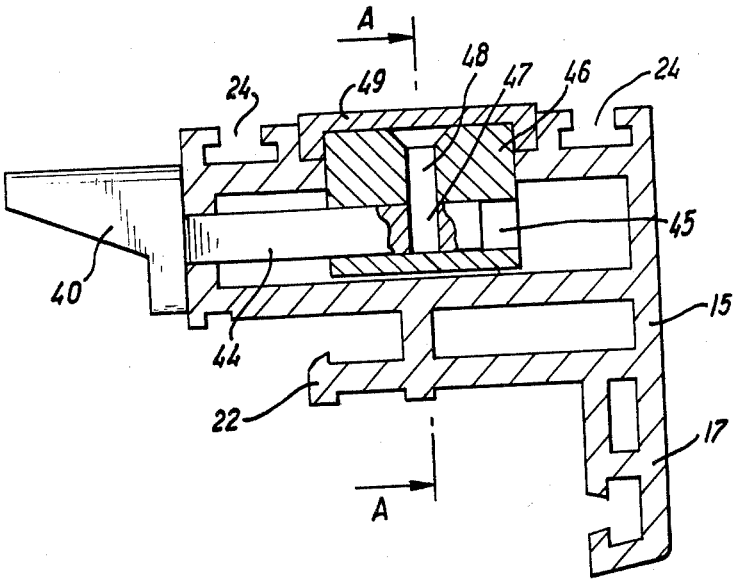
FIG. 7 is a vertical cross-section through an upper corner of a sash frame showing the tilt release mechanism.
Figure 8:
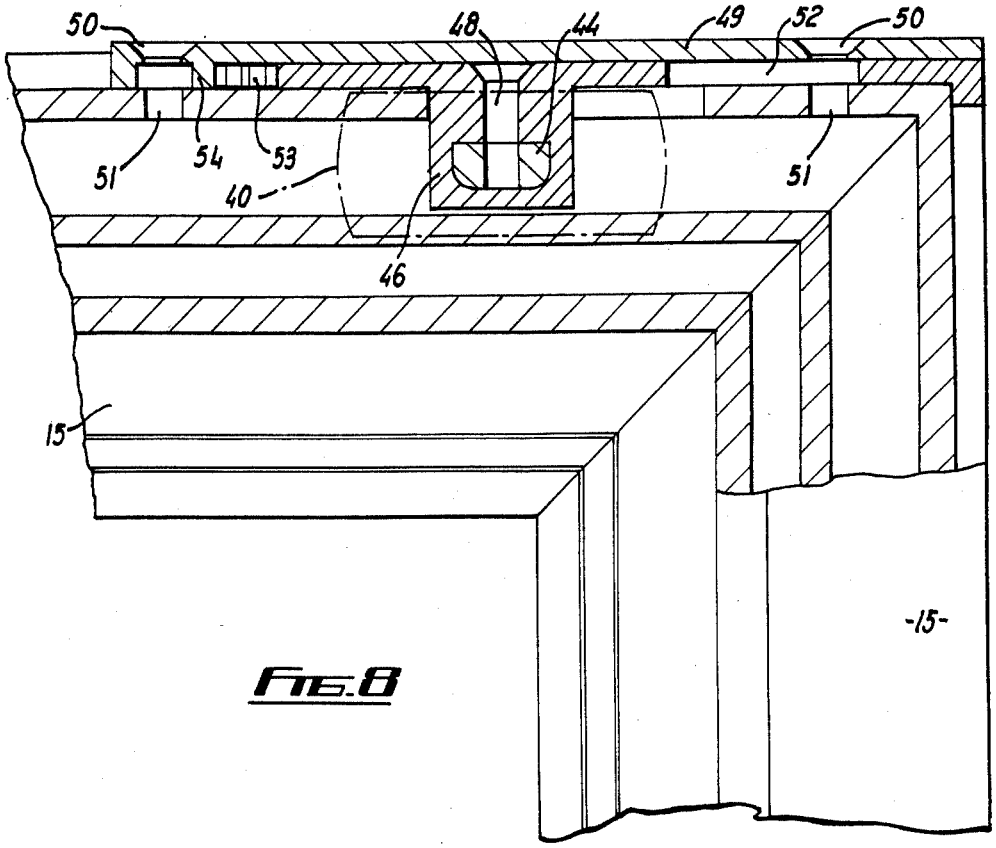
FIGS. 8 and 9 are vertical cross-sections on the line A—A in FIG. 7 showing the tilt release mechanism in alternative positions of use.
Figure 9:
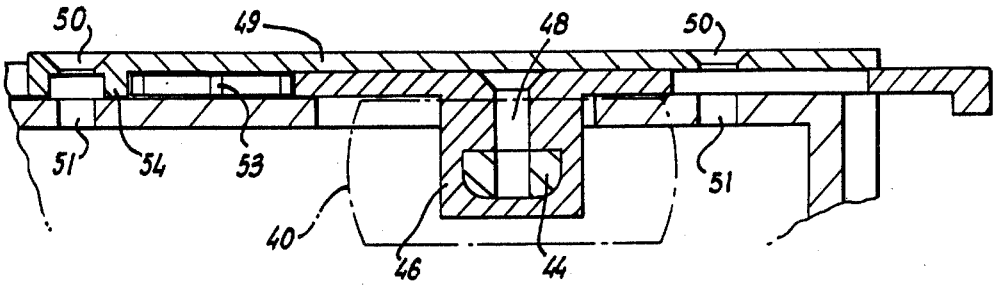

In order to accommodate the tilt release mechanism the upper corners of each of the sash frames are modified by the provision of apertures shown in FIGS. 4 and 5. A rectangular aperture 41 is provided in the central channel 25 and circular holes 42 to receive mounting screws are provided at each side of the aperture 41. In addition an elongated slot 43 is provided in the front face of the upper frame member 15 in alignment with the aperture 41. The handle 40 is provided with a projecting shank 44 which passes through the slot 43 and engages in an aperture 45 in an abutment portion 46 of the slidable guide member 13B. The shank 44 is secured to the guide member by a screw (not shown) inserted through complementary apertures 47 and 48 in the shank 44 and guide member 13B respectively. The length of the slot 43 is such that it is concealed by the handle 40 in both the extended and retracted positions of the guide member 13B.

A detachable cover plate 49 is adapted to be received within the central channel 25 and secured to the frame by means of screws (not shown) inserted through apertures 50 in the cover plate into engagement with apertures 51 (FIGS. 8 and 9) in the frame members 15. The screw nearest to the corner of the frame passes through a slot 52 in the guide member 13B which allows the latter to slide relative to the frame between extended and retracted positions defined by abutment of the portion 46 of the guide member 13B with the respective ends of the aperture 41 in the frame member. The underside of the cover plate 49 is recessed to accommodate the guide member 13B and a spring 53 is located between an abutment 54 (FIGS. 8 and 9) on the underside of the cover plate 49 and the inner end of the guide member 13B. The spring 53 serves to urge the guide member into its extended position in which it projects beyond the side frame member 15 and engages in the slot 10 in the side member 7 of the outer frame 5. A similar arrangement is provided at each of the top corners of both sash frames 6A and 6B save that in the case of the upper sash frame 6A the handles 40 are inverted as shown in FIG. 2.

In order to slide the sash frames relative to the outer frame 5 the handles 40 are pushed upwards or downwards and the balance gear holds the sash frames in any desired vertically adjusted position relative to the frame 5. In order to release the sash frames for tilting relative to the outer frame 5 and the handles 40 on each sash frame are simultaneously moved inwardly to retract the guide members 13B from the slots 10 at opposite sides of the frame 5 and thereby permit the sash frame to pivot about the connecting members 13. In order to tilt the lower sash frame it is necessary to lift it clear of the track 38 in the frame 5, following which it may be released and pivoted inwardly to enable access to the outer surface of the glazing unit for cleaning purposes. Due to expansion of the guide blocks 13A on tilting of the sash frame, the frame may be tilted in any vertical position provided the lower frame member is clear of the channel 38. The upper sash frame may only be tilted following tilting of the lower sash frame, but may be adjusted to any desired vertical position prior to actuation of the tilt release mechanism by inward movement of the handles 40.

Figure 3:
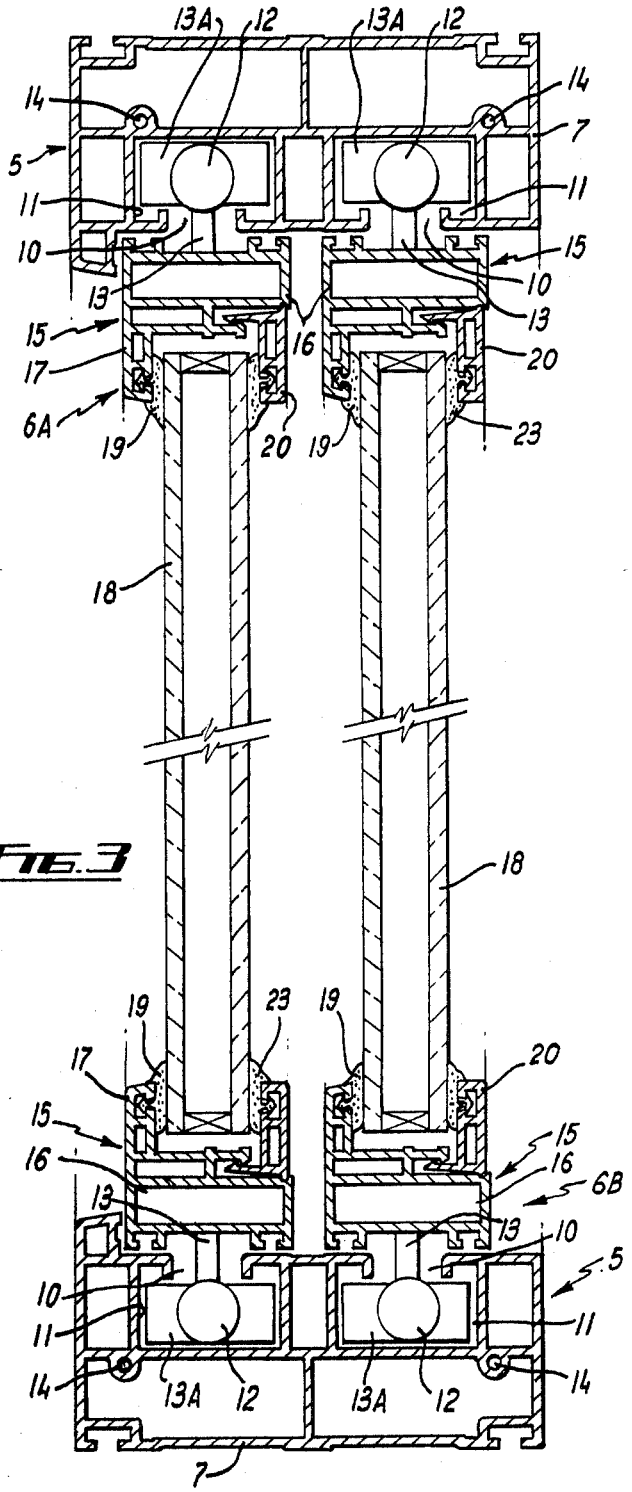
FIG. 3 is a horizontal cross-section through the window construction.
Figure 10:
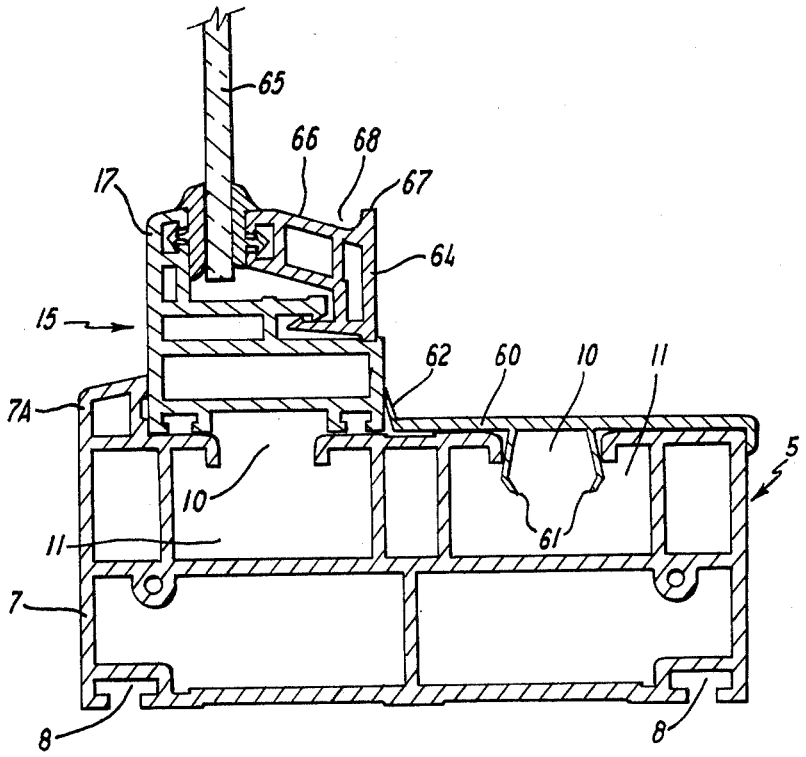
FIG. 10 is a fragmentary horizontal cross-section showing a modification.

FIG. 10 shows an arrangement in which the same outer frame houses a single glazed fixed frame only. The outer frame is constructed from frame members 7 the same as those employed in the embodiment shown in FIGS. 1 to 3 and the fixed frame is located at the outer region of the outer frame in contact with the abutments 7A on the frame members 7. The inner slots 10 in the frame members 7 are covered by detachable cover members 60 provided with flexible projections 61 which engage with the edges of the slots 10 and retain the cover members in position. Flexible lip portions 62 on the cover members 60 contact the adjacent surfaces of the fixed frame to form a seal and present a neat appearance. The fixed window frame is constructed from frame components 15 the same as those utilised in FIGS. 1 to 3, but in this instance a modified glazing bead 64 is fitted which projects for a greater distance towards the fixed abutment 17, to engage the single pane glazing unit 65. The glazing bead is also provided with a sloping upper surface 66 and an upwardly directed lip 67 which form a channel or gutter 68 for collection or condensation. Collected condensation may be allowed to evaporate or can be wiped away. Alternatively drain holes (not shown) may be provided to channel the condensation to the outside of the frame.

It will be appreciated that the outer frame may also be employed in a window having a fixed frame and one or more sash frames, or a single sash frame and one or more fixed inner frames dependent on requirements. The fixed and sash frames may be single, double or multiple glazed as desired.

Windows constructed in accordance with the arrangements described above have several advantages over traditional sliding sash windows. Both the outer frame and the sash frames are constructed from identical top, bottom and side frame components which may thus all be cut from a common extrusion. This avoids the production of several components of different section and considerably simplifies manufacture and assembly of the frames. Moreover the frame members are secured together at the corners of the frame by welding which produces a weather-tight seal and which is rendered possible in the case of the sash frames by the use of detachable glazing beads or strips to retain the glazing units in position. This is particularly advantageous compared with traditional sash windows which are glazed by removal of one side of the frame and which give rise to considerable problems in the event of the glazing unit being broken.

Adaptation of the common frame members to enable their use at the top, bottom or side of the frame is readily effected by clip-on components formed from plastics material by extrusion and which can therefore be cut to suitable lengths dependent on varying circumstances. The cover member for fitting to the bottom of the outer frame member enables good weather sealing to be readily attained by virtue of the provision of the recessed track and sloping sill portions while providing a pleasing internal and external appearance. The exposed edges of the sash frames in addition to being covered by clip-on cover members are automatically provided with overlapping sealing members due to the provision of the combined cover and sealing components. Moreover by virture of the fact that these components can be fitted to the frame members in different position, both frames can be provided with covers and sealing members using section cut from the same extrusion. Both the inner and outer frames also have the usual benefits associated with plastics construction and in particular are not susceptible to rotting or tarnishing and do not require painting or other maintenance.

A further advantage arises from the provision of the combined lifting handles and tilt locking actuators 40. These enable the combined functions of sliding the sash frames between their open and closed positions and actuating the tilt lock mechanism to be performed by a single member while presenting a neat appearance to the finished frame.

Various modifications may be made without departing from the invention. For example while the arrangement described in FIGS. 1 to 3 incorporates two inner frames, three or more inner frames may be incorporated, any one or more of which may be slidable. Moreover while the drawings illustrate arrangements in which the sash frames slide vertically, they may be arranged to slide horizontally. The inner frames, whether fixed frames or sash frames, may be single, double or multiple glazed as desired dependent on requirements. In a further modification the tilt locking mechanism may be actuated by rotary rather than linear movement of the lifting handles.

I claim :

1. A sash for a sliding window construction, the sash frame being of rectangular form comprising four frame members formed from plastics material and of identical cross-sectional profile, the frame members being fused or welded together at their corners and incorporating fixed abutments for engagement with a glazing unit, and removable glazing beads attachable to said frame members whereby the glazing unit may be inserted laterally into the frame and retained in engagement with said abutments by attachment of said glazing beads to the assembled frame, the outer edges of each of said frame members being provided with longitudinally extending recesses to accommodate sealing members engageable with adjacent portion of an outer frame in which the sash frame is slidably mounted in use, and a detachable sealing member mounted on one horizontal member of said sash frame whereby to provide a seal between adjacent vertical faces of the sash frame and a further frame also mounted in said outer frame, when said sash is in its closed position.

2. A sash frame according to claim 1, wherein a plurality of alternatively usable removable glazing beads are provided which may be selectively attached to the frame members and are adapted to accommodate different glazing units which may be mounted in the frame.

3. A sash frame according to claim 1, wherein said glazing beads are provided with retaining means adapted for engagement with complementary retaining means formed on the frame components to secure the glazing beads in position.

4. A sash frame according to claim 1, wherein said glazing beads are formed from plastics material and of constant cross-section throughout their lengths.

5. A sash frame according to claim 1, wherein said detachable sealing member is carried by a cover member attachable to the outer edges of said horizontal frame member to cover said longitudinal recesses therein.

6. A sash frame according to claim 5, wherein said cover members and sealing members are formed from plastics material and of constant cross-section throughout their lengths.

7. A sash frame according to claim 1, wherein said detachable sealing member is provided with retaining means co-operable with complementary retaining means on said frame members to enable a clipping connection therewith.

8. A sash frame according to claim 7, wherein said complementary retaining means comprises said longitudinal recesses.

9. A sliding sash window having an outer frame, upper and lower sash frames mounted in the outer frame, at least one of said sash frames being slidable relative to the outer frame and the other sash frame, the or each sliding sash frame being of rectangular form comprising four frame members formed from plastics materials and of identical cross-sectional profile, the frame members being fused or welded together at their corners and incorporating fixed abutments for engagement with a glazing unit, and removable glazing beads attachable to said frame members whereby the glazing unit may be inserted laterally into the frame and retained in engagement with said abutments by attachment of said glazing beads to the assembled frame, the outer edges of each of said frame members being provided with longitudinally extending recesses to accommodate sealing members engageable with adjacent portions of the outer frame, and a detachable sealing member being mounted on one horizontal member of said sliding sash frame whereby to provide a seal between adjacent vertical faces of the respective sash frames when the or each sliding sash frame is in its closed position.

* * * * *